United States Patent [19]

Patterson

[11] 4,336,637

[45] Jun. 29, 1982

[54] SAFETY CLAMP

[76] Inventor: Robert E. Patterson, 614 Shady Glen, Allen, Tex. 75002

[21] Appl. No.: 148,919

[22] Filed: May 12, 1980

[51] Int. Cl.[3] ..... A44B 21/00

[52] U.S. Cl. ..... 24/249 DP; 81/61; 73/862.26

[58] Field of Search ..... 24/249 DP; 81/60, 61, 81/62; 73/862.26

[56] References Cited

U.S. PATENT DOCUMENTS

| | | | |
|---|---|---|---|
| 1,494,513 | 5/1924 | Stewart et al. | 81/61 |
| 2,074,079 | 3/1937 | Bahr et al. | 73/862.26 X |
| 2,229,607 | 1/1941 | Poist et al. | 24/249 DP X |
| 2,465,695 | 3/1949 | Osbourne | 81/61 X |
| 2,644,713 | 7/1953 | Failing | 24/249 DP X |
| 3,037,258 | 6/1962 | Stokes | 24/249 DP |
| 3,105,281 | 10/1963 | Doherty | 24/249 DP |
| 3,732,756 | 5/1973 | Thomasian | 81/62 |
| 3,788,132 | 1/1974 | Trimble et al. | 73/862.26 |

*Primary Examiner*—Dennis L. Taylor
*Attorney, Agent, or Firm*—Jane F. Booth; Gerald G. Crutsinger; Monty L. Ross

[57] ABSTRACT

A clamp used on pipe comprises a clamp having a body adapted to be positioned around the pipe having first and second ends, gripping members for engaging the pipe connected to the body and a screw member pivotally connected to the first end of the body for extending through a passageway in a member connected to the other end of the body. A wrench is used with the clamp for tightening the clamp portion around the pipe having a nut matingly engaging the threaded member to move the threaded member relative thereto, a handle for transferring a torque to the nut and apparatus connecting the nut to the handle, which has a ratchet for transferring the torque to the nut when the handle is turned in a first direction while permitting movement of the handle in an opposite direction without applying a torque to the nut.

5 Claims, 2 Drawing Figures

SAFETY CLAMP

BACKGROUND AND BRIEF SUMMARY OF THE INVENTION

The use of clamps in well drilling operations are well known. Some examples of this use are guarding against dropping flush joint pipe, streamline drill collars, and similar items into the hole while making up or breaking out the string; as an emergency elevator shoulder for lifting prepacked gravel liners, flush joint pipe, twisted off fish and similar items having no shoulders for attaching conventional elevators; as slip and elevator combinations when running large diameter surface casing; and, then inverted, as a hold down against flotation of surface pipe during cementing operations.

One example of such safety clamp is the—Baash-Ross Safety Clamp, manufactured by Joy Manufacturing Company, designated as type "C safety clamp". This safety clamp comprises individual lengths flexibly hinged to one another to form a linkage mechanism with each length having the separate tapered slip to act as a gripping member. The clamp is tightened by use of a threaded rod extending through a nut, such that each slip can take a firm initial grip on the surface of the pipe. The linkage mechanism is used to that substantial uniform gripping pressure is provided around the pipe which aids in preventing the crushing of thin wall pipe or damaging the pipe's surface. To tighten the clamp on the pipe, a separate wrench is provided. Since the wrench is separate, it may become lost. Further, normally the particular wrench provided is a box-end wrench which does not enable manipulation in relatively tight places. Also, even though a linkage mechanism is used to prevent the crushing of thin wall pipe, normally the particular wrench provided does not have any means of indicating the amount of torque applied to such clamp so as to further aid in preventing the crushing of the thin wall pipe or damaging the pipe's surface.

Accordingly, it is an object of the present invention to provide a safety clamp used on pipe that includes a combined clamp and a wrench portion so as to inhibit the likelihood of loss of a particular portion of the clamp.

Further, it is an object of the present invention to provide a safety clamp used on pipe that includes a ratchet arrangement to facilitate tightening or loosening the clamp in difficult hard to reach areas.

Further, it is an object of the present invention to provide a safety clamp used on a pipe that includes a torque indicator so as to inhibit the likelihood of damage to thin wall pipe or damaging the pipe's surface.

In accordance with the invention, a safety clamp used on pipe comprises a clamp portion for encircling the pipe. The clamp portion includes a body adapter to be positioned around the pipe having first and second ends opposed members for gripping the pipe connected to the body, and a threaded member pivotally connected to the first end of the body for extending through a passageway in a member connected to the second end of the body. A wrench portion for tightening the clamp portion around the pipe includes a nut for moving the threaded member relative thereto and a handle for transferring a torque to the nut. Apparatus connects the nut to the handle and has a ratchet mechanism to transfer the torque from the handle to the nut when the handle is turned in a first direction while permitting movement on the handle in an opposite direction without applying a torque to the nut.

Further in accordance with the invention, a wrench is used to tighten a clamp onto a pipe. The clamp includes a body having first and second ends, opposed members for gripping the pipe connected to the body and a threaded member connected to the first end of the body and extending through a passageway in a member connected to the second end of the body. The wrench comprises a nut adapted to matingly engage the threaded member of the clamp and a handle for applying a torque to the nut. Apparatus connects the nut to the handle and includes a ratchet mechanism for transferring the torque to the nut when the handle is turned in a first direction to move the threaded member relative to the nut to tighten or loosen the clamp on the pipe while permitting movement of the handle in an opposite direction without applying torque to the nut, and a mechanism is connected to the handle for indicating the torque applied to the nut when the handle is moved to transfer torque to the nut.

BRIEF DESCRIPTION OF THE DRAWINGS

Other objects and advantages of the invention will become apparent upon reading the following detailed description and upon reference to the drawings, in which like reference characters are used throughout to designate like parts.

DETAILED DESCRIPTION OF THE INVENTION

Figure 1:
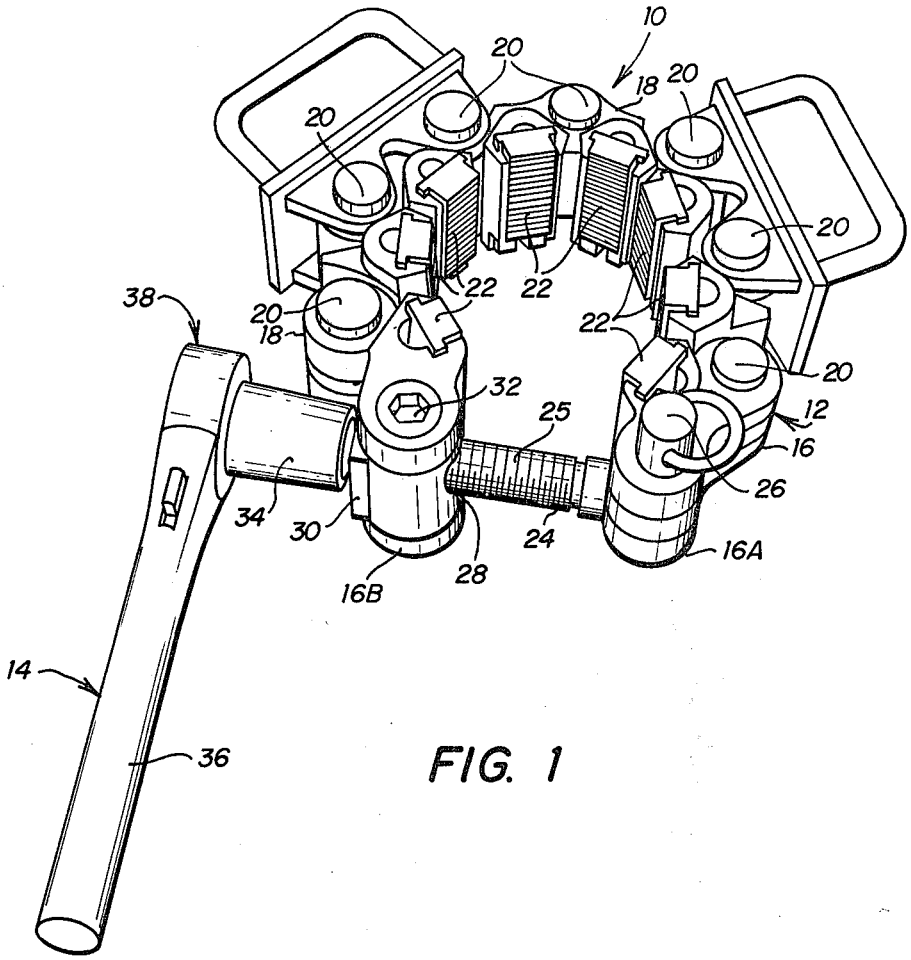
FIG. 1 is a perspective view of a safety clamp constructed according to the present invention.
Figure 2:
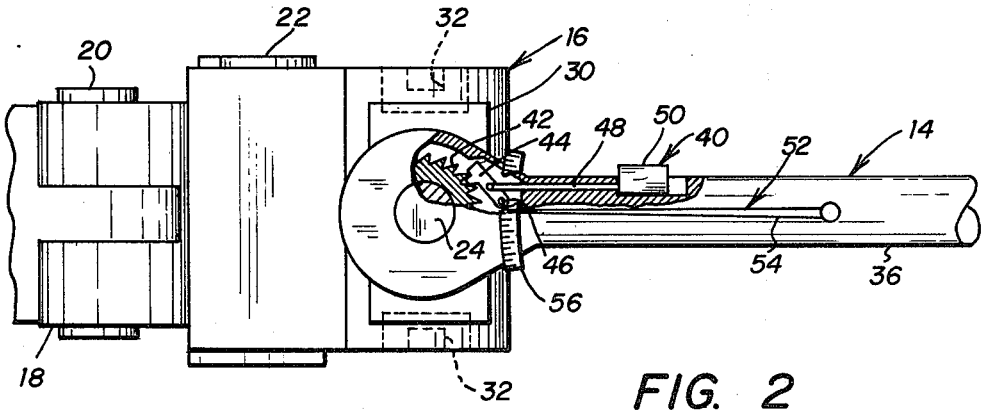
FIG. 2 is an enlarged elevational view of a portion of the invention shown in FIG. 1.

Turning to the drawings, there is shown a safety clamp 10 used on a pipe (not shown) constructed according to the present invention. Safety clamp 10 includes a clamp portion 12 for extending around or encircling the pipe and a wrench portion 14 for tightening clamp portion 12 onto the pipe.

Calmp portion 12 includes a body 16 adapted to encircle or be positioned around the pipe and having a first end 16A and a second end 16B. Body 16 is preferably of a linkage construction having a plurality of individual link members 18 pivotally connected to one another by pins 20 so as to provide a substantially uniform pressure around the pipe.

Opposed gripping members 22 are connected to body 16 for engaging the pipe. Since body 16 is preferably formed by a plurality of individual links 18, it is preferred that a gripping member 22 be connected to each link 18.

A screw member 24 having male threads 25 is pivotally connected to first end 16A of body 16 by pin 26 and extends through a passageway 28 in a shoulder abutting member 30 pivotally connected by set screws 32 to a link member 18 at second end 16B of body 16.

Wrench portion 14 includes a nut 34 having a passageway with female threads extending annularly of the passageway and matingly engaging the male threads on screw member 24. Thus, when nut 34 is rotated screw member 24 is moved axially through the nut which thereby draws the first and second ends, 16A and 16B, of body 16 toward one another.

A handle 36 is provided to transfer a torque to nut 34 which turns nut 34 relative to screw member 24 and thereby moves the screw member axially of the nut and tightens or loosens clamp portion 12 on the pipe. Handle 14 should be made from material capable of absorbing harsh treatment, such as hammering which occurs when using safety clamp 10.

Apparatus 38 connects nut 34 to handle 36 and includes a ratchet 40 that transfers the torque to nut 34 when handle 14 is turned in a first direction while permitting movement of the handle in an opposite direction without applying a torque to the nut. Although ratchet 40 may be of any conventional design, it is preferred to include a ratchet wheel 42 welded to nut 34 and disposed coaxially around the passageway extending through said nut so as to enable screw member 24 to extend through wrench portion 14. Thus, permitting safety clamp 10 to be used on pipe of more varying diameters than with a wrench having no passageway. A first assembly having pawl 44 pivotally attached by pin 46 to handle 14 and a link member 48 extends between pawl 44 and a switch 50 slideably disposed within handle 41 so as to move pawl 44 into and out of engagement with the teeth on wheel 42 is disposed on one side of handle 14 and a second assembly similar to the first assembly is disposed on the other side of handle 14 so that the torque transferred to nut 34 may be applied in either direction as well as permitting a direct drive in both directions.

A torque force indicator 52 to aid in preventing injury to the pipe to which clamp 10 is being attached is provided on handle 14 to indicate the amount of torque applied to nut 34. Although torque indicator 52 may be of any conventional design, it is preferred the torque indicator include a pointer 54 fixedly attached at a fixed end for extending axially along handle 14 into a pointing end, and a torque indicator 56 disposed adjacent the pointing end of pointer 54. Thus, when handle 54 is moved in a direction providing torque to nut 34, pointer 54 will move relative to indicator 56 to indicate the amount of torque applied to nut 34. The user is thus able to determine whether damage may be occurring to the pipe as well as whether threaded member 24 or nut 34 on both may be damaged.

The invention having been described, what is claimed is:

1. A clamp used on a pipe, comprising: a clamp portion for extending around and attaching to the pipe, said clamp portion including a body adapted to be positioned around the pipe having a first and a second end, gripping members for engaging the pipe connected to the body, and a screw member pivotally connected to the first end of the body for extending through a passageway in a member connected to the second end of the body; and a wrench portion for tightening said clamp portion around the pipe, said wrench portion including a nut for moving the threaded member relative thereto, a handle for transferring a torque to said nut, and means for connecting the nut to the handle, said connecting means having ratchet means for transferring the torque to the nut when the handle is turned in a first direction while permitting movement of the handle in an opposed direction without applying torque to the nut, said wrench portion and said ratchet means further comprising a cylindrical passageway coaxial with said nut to enable said screw member to extend through said wrench portion as said clamp is tightened around said pipe.

2. A clamp as set forth in claim 1, further comprising: means connected to said handle for indicating the torque transferred to said nut from said handle.

3. A clamp used on well pipe, comprising: a body adapted to be positioned around the pipe having first and second ends; opposed members for gripping the pipe connected to said body; a threaded male member pivotally connected to the first end of said body; a shoulder abutting member connected to the second end of said body and having a passageway through which said threaded member extends; a nut having female threads for matingly engaging said threaded male member when extending through the passageway in said shoulder abutting member; a handle for transferring a torque to said nut; and means for connecting said nut to said handle, said connecting means including ratchet means for transferring the torque to said nut when said handle is turned in a first direction while permitting movement of the handle in an opposed direction without applying a torque to said nut, said ratchet means and said means for connecting said nut to said handle further comprising a cylindrical passageway coaxial with said nut to enable said threaded member to extend through said ratchet means and said means for connecting said nut to said handle as said clamp is tightened around said pipe.

4. A clamp as set forth in claim 3 further comprising: means connected to said handle for indicating the torque transferred to said nut from said handle.

5. A wrench adapted to tighten a clamp onto well pipe, said clamp including a body having first and second ends, opposed members for gripping the pipe connected to the body, a threaded male portion for moving the opposed gripping members relative to one another connected to the first end of the body and extending through a passageway in a shoulder abutting member connected to the second end of the body, comprising: a nut adapted to mattingly engage the threaded member of said clamp; a handle for applying a torque to said nut; means for connecting said nut to said handle, said connecting means including ratchet means for transferring the torque to said nut when said handle is turned in a first direction while permitting movement of said handle in an opposed direction without applying a torque to said nut, said means for connecting said nut to said handle further comprising a cylindrical passageway coaxial with said nut to enable said threaded member to extend through said means for connecting said nut to said handle as said clamp is tightened around said pipe; and means connected to said handle for indicating the torque applied to said nut when said handle is moved to tighten or loosen the clamp on the pipe.

* * * * *

UNITED STATES PATENT AND TRADEMARK OFFICE

CERTIFICATE OF CORRECTION

PATENT NO. : 4,336,637

DATED : June 29, 1982

INVENTOR(S) : Robert E. Patterson

It is certified that error appears in the above-identified patent and that said Letters Patent are hereby corrected as shown below:

On the title page:

In listing the Attorney, Agent, or Firm - delete Jane and insert -- John --.

Signed and Sealed this

Nineteenth Day of October 1982

[SEAL]

*Attest:*

GERALD J. MOSSINGHOFF

*Attesting Officer*

*Commissioner of Patents and Trademarks*